US008474217B2

(12) United States Patent
Paton

(10) Patent No.: US 8,474,217 B2
(45) Date of Patent: Jul. 2, 2013

(54) FRAMING AID

(76) Inventor: Gordon Andrew Paton, Sharon (CA)

( * ) Notice: Subject to any disclaimer, the term of this patent is extended or adjusted under 35 U.S.C. 154(b) by 47 days.

(21) Appl. No.: 13/064,039

(22) Filed: Mar. 3, 2011

(65) Prior Publication Data

US 2011/0214389 A1 Sep. 8, 2011

Related U.S. Application Data

(60) Provisional application No. 61/311,039, filed on Mar. 5, 2010.

(51) Int. Cl.
*E04D 15/00* (2006.01)

(52) U.S. Cl.
USPC ..... 52/749.1; 33/562

(58) Field of Classification Search
USPC ..... 52/749.1; 33/562, 613; 269/41, 43
See application file for complete search history.

(56) References Cited

U.S. PATENT DOCUMENTS

| | | | | |
|---|---|---|---|---|
| 2,567,586 | A | 8/1950 | Werder | |
| 2,744,334 | A * | 5/1956 | Jondole | 33/613 |
| 5,031,886 | A * | 7/1991 | Sosebee | 269/41 |
| 5,129,153 | A | 7/1992 | Burns | |
| 5,396,710 | A * | 3/1995 | Battaglia | 33/429 |
| 5,490,334 | A | 2/1996 | Payne | |
| 5,628,119 | A | 5/1997 | Bingham | |
| 6,070,336 | A | 6/2000 | Rodgers | |
| 6,293,028 | B1 | 9/2001 | Sylvia | |
| 6,381,908 | B1 | 5/2002 | Fisher | |
| 6,385,859 | B1 | 5/2002 | Varney | |
| 6,702,270 | B1 | 3/2004 | Reschke | |
| 6,775,916 | B2 | 8/2004 | Sparkes | |
| 6,895,684 | B1 | 5/2005 | Firth | |
| 7,979,997 | B2 * | 7/2011 | Pianetto | 33/613 |
| 8,191,335 | B2 * | 6/2012 | Davis | 52/749.1 |
| 2004/0074101 | A1 | 4/2004 | Dillard | |
| 2004/0237450 | A1 | 12/2004 | Barborka | |
| 2006/0010703 | A1 | 1/2006 | Gauthier | |
| 2006/0236554 | A1 | 10/2006 | Peterson | |
| 2006/0260219 | A1 | 11/2006 | Riddle | |
| 2007/0119067 | A1 | 5/2007 | Mackey | |
| 2008/0006976 | A1 | 1/2008 | Riley | |
| 2009/0146354 | A1 | 6/2009 | Metroyanis | |

* cited by examiner

*Primary Examiner* — Jeanette E Chapman
*Assistant Examiner* — Daniel Kenny

(57) ABSTRACT

A portable jig used in light frame construction has a rigid body formed from a resilient material that is approximately rectangular in shape with a central planar web with a peripheral, perpendicular flange, and at least three saddles, attached to the central planar web. The jig also possesses a vertical framing flange that extends from one of the saddles and is parallel to the central planar web. The longitudinal axes of at least two of the saddles are parallel to each other and are spaced apart in conformity with standard building code spacing. The longitudinal axis of at least one of the remaining saddles is perpendicular to the aforementioned parallel saddles. These saddles are used to position the vertical framing elements at the desired spacing and at the same time ensure that they perpendicular to the horizontal framing elements.

17 Claims, 12 Drawing Sheets

FRAMING AID

CROSS-REFERENCE TO RELATED APPLICATIONS

This application claims the benefit of U.S. Provisional Application No. 61/311,039 filed Mar. 5, 2010 and entitled "Framing Aid", the contents of which are incorporated herein by reference.

FIELD OF INVENTION

The invention relates to the art of framing jigs.

BACKGROUND OF INVENTION

The light frame construction of wall, roof or floor structures must be completed in accordance with local Building Codes. These Codes outline the requirements for construction of these structures including acceptable materials, material sizes and the configuration of the framed structures. Typical vertical wall framing practice is to mechanically fasten a series of vertical framing elements (studs) to upper and lower horizontal framing elements (header plates and sills). The studs are oriented perpendicularly to the header plates and sills and are typically spaced such that the distance between the centers of adjacent studs does not exceed 16 inches. Some framing applications require the stud spacing to be as small as 12 inches while other less stressed framing applications may permit the inter-stud spacing to increase to 24 inches.

Traditional framing techniques are based on the layout and marking of the sill and header plates with a tape measure and pencil to identify the correct stud attachment positions. The studs are then held in the correct position by the fabricator, oriented approximately perpendicularly to the sill or header plate and then mechanically fastened in place with either nails or screws. The perpendicular orientation of the studs relative to the sill or header plate is typically confirmed using a framing square. It can be difficult to hold the stud in the correct location and at the correct orientation while mechanically fastening the stud to the sill or header plate without the assistance of a helper, particularly for persons who do not do this for a living. It should be noted that the construction of framing elements can be completed either as a separate module to be installed in the structure as a single element (horizontal framing) or they can be constructed in place during the fabrication of the building (vertical framing). In either case, the studs are typically located, oriented and fastened in place according to the above described process with similar challenges associated with the correct positioning and orientation of the studs relative to the sill and header plates. In addition, framing elements fabricated in place require the use of a fastening technique called toe-nailing wherein the fabricator attaches the studs to the plates by driving the fasteners at an angle through the studs and into the sill and header plates since it is impossible to fasten through the plates into the studs once the plates have been installed.

During the construction of wall elements, it may be desirable to include openings in the framing for windows and doors. These elements also require the accurate layout, location and orientation of framing elements.

There are numerous framing aids that have been developed that focus on the accurate spacing of studs. U.S. Pat. No. 5,490,334 to Payne (1996) discloses a tool that spaces the studs the correct distance but does not address the need to hold the stud perpendicular to either the sill or the header plate.

U.S. Patent Application Publication US 2008/0006976 A1 by Riley addresses the need to brace the studs during fastening but describes the use of two small flanges on either side of the stud openings to provide this functionality. This method cannot be relied upon to accurately orient a stud the length of which is approximately 200 times the height of these flanges. This tool is not suitable for framing elements that are less than 3½" in depth and requires the use of temporary fasters to positively locate the tool to the sill or header plate since the tool does not positively engage the framing elements on its own. In addition, this tool would be very cumbersome to use based on its length and utilizes spacers to position the studs at various spacings that could result in errors if used incorrectly by an unskilled worker.

A stud spacing and orientation jig disclosed in U.S. Pat. No. 2,567,586 to Werder (1951) uses an angle iron with positioning lugs to orient the timbers in the desired attitude. The angle iron does not allow the jig to laterally retain the timbers on its own without the use of tacking nails since the jig does not enclose the sill on each side. The installation and removal of these tacking nails would increase the time required to complete the framing task. In addition, the use of the solid positioning lugs dictates that the fabricator must end nail the studs to the sill or header plates as there would be no access to toenail the studs to the sill or header plate.

Thus, there remains a need for a tool that can be used by a single person, which is especially suited for the home handyman or so-called 'do it yourselfer', to accurately position, orient and retain framing elements during construction.

SUMMARY OF INVENTION

According to one aspect of the invention a framing aid is provided having a central web; at least first and second stud saddles connected to the web. The first stud saddle has a first longitudinal axis and the second stud saddle has a second longitudinal axis. The first and second longitudinal axes are substantially parallel to one another. At least one sill saddle is connected to the web, the sill saddle having a third longitudinal axis that is substantially perpendicular to the first and second longitudinal axes of the stud saddles. The sill saddle is spaced apart and not immediately adjacent to the first and second stud saddles so as to provide a first opening between the sill saddle and the first stud saddle and a second opening between the sill saddle and the second stud saddle. These openings provide access points to allow a fabricator to toenail studs thereat.

The connection of saddles to the central web is achieved by integrally forming the web with the saddles, for example in a molding process, or by mechanically connecting the web with the saddles.

The central web preferably includes a planar substrate having a first side and a second side substantially perpendicular to the first side. The first stud saddle is disposed adjacent to the first side of the substrate and the sill saddle is disposed adjacent the second side of the substrate.

At least one of the first and second stud saddles may be provided a two-sided body having first and second sidewalls, the first sidewall being connected and generally orthogonal to the substrate and the second sidewall being connected to the first sidewall and generally parallel with the substrate.

Alternatively, the first and second stud saddles may be provided as a three-sided body having first, second and third sidewalls, the first sidewall being connected to and generally orthogonal to the substrate, the second sidewall being connected to the first sidewall and generally parallel with the substrate, and the third sidewall being connected to the second sidewall and generally orthogonal to the substrate, wherein the spacing between the first and third sidewalls substantially defines the maximum depth of a framing stud accommodated in the saddle.

Likewise, the sill saddle maybe provided as a two-sided body having first and second sidewalls, the first sidewall being connected and generally orthogonal to the substrate and the second sidewall being connected to and generally parallel with the substrate. Alternatively, the sill saddle may be provided as a three-sided body having first, second and third sidewalls, the first sidewall being connected and generally orthogonal to the substrate, the second sidewall being connected to the first sidewall and generally parallel with the substrate, and the third sidewall being connected to the second sidewall, wherein the spacing between the first and third saddle sides substantially defines the maximum depth of a stud accommodated in the saddle. More preferably, however, the sill saddle further includes a two-sided sill body connected to the three-sided body, the two-sided body comprising the third wall of the three-sided body and a fourth wall connected to and parallel with the second wall of the three-sided body.

The planar substrate may include at least one aperture formed therein having a flange at the periphery of the aperture for stiffening the substrate.

In addition, a stiffening flange may substantially circumscribe the planar substrate, the flange being orientated substantially orthogonal to the substrate. If provided, the flange may define a portion of each of the saddles.

According to another aspect of the invention a framing aid is provided which includes a central web including a planar substrate; first and second stud saddles connected to the web, the first stud saddle having a first longitudinal axis and the second stud saddle having a second longitudinal axis, the first and second longitudinal axes being substantially parallel to one another, wherein each of the first and second stud saddles is a three-sided body having a first sidewall connected to and generally orthogonal to the substrate, a second sidewall connected to the first sidewall and generally parallel with the substrate, and a third sidewall connected to the second sidewall and generally orthogonal to the substrate; and a sill saddle connected to the web, the sill saddle having a third longitudinal axis that is substantially perpendicular to the first and second longitudinal axes of the stud saddles, the sill saddle comprising a three-sided body connected to a two-sided body, the three sided body having a first sidewall connected and generally orthogonal to the substrate, a second sidewall connected to the first sidewall and generally parallel with the substrate, and a third sidewall connected to the second sidewall, the two-sided body comprising the third wall of the three-sided body and a fourth wall connected to and parallel with the second wall of the three-sided body.

Preferably, the sill saddle is spaced apart and not immediately adjacent to the first and second stud saddles so as to provide a first opening between the sill saddle and the first stud saddle and a second opening between the sill saddle and the second stud saddle, the openings each being adequately sized for toe nailing studs.

The framing aid according to this aspect of the invention may also include a flange substantially circumscribing the planar substrate, the flange being orientated substantially orthogonal to the substrate in order to stiffen it. The flange may define a portion of each of the saddles.

According to another aspect of the invention a framing aid is provided which includes a central planar web; at least three stud-gripping saddles connected to the central planar web, wherein each saddle has a longitudinal axis and at least two of the saddles have longitudinal axes parallel to each other and the longitudinal axis of at least one saddle is perpendicular to the at least two parallel saddles; and a flange that extends from the at least one perpendicular saddle and is parallel to the central planar web.

BRIEF DESCRIPTION OF DRAWINGS

The foregoing and other aspects of the invention will be better understood with reference to the drawings, wherein.

DETAILED DESCRIPTION OF PREFERRED EMBODIMENTS

Figure 1:
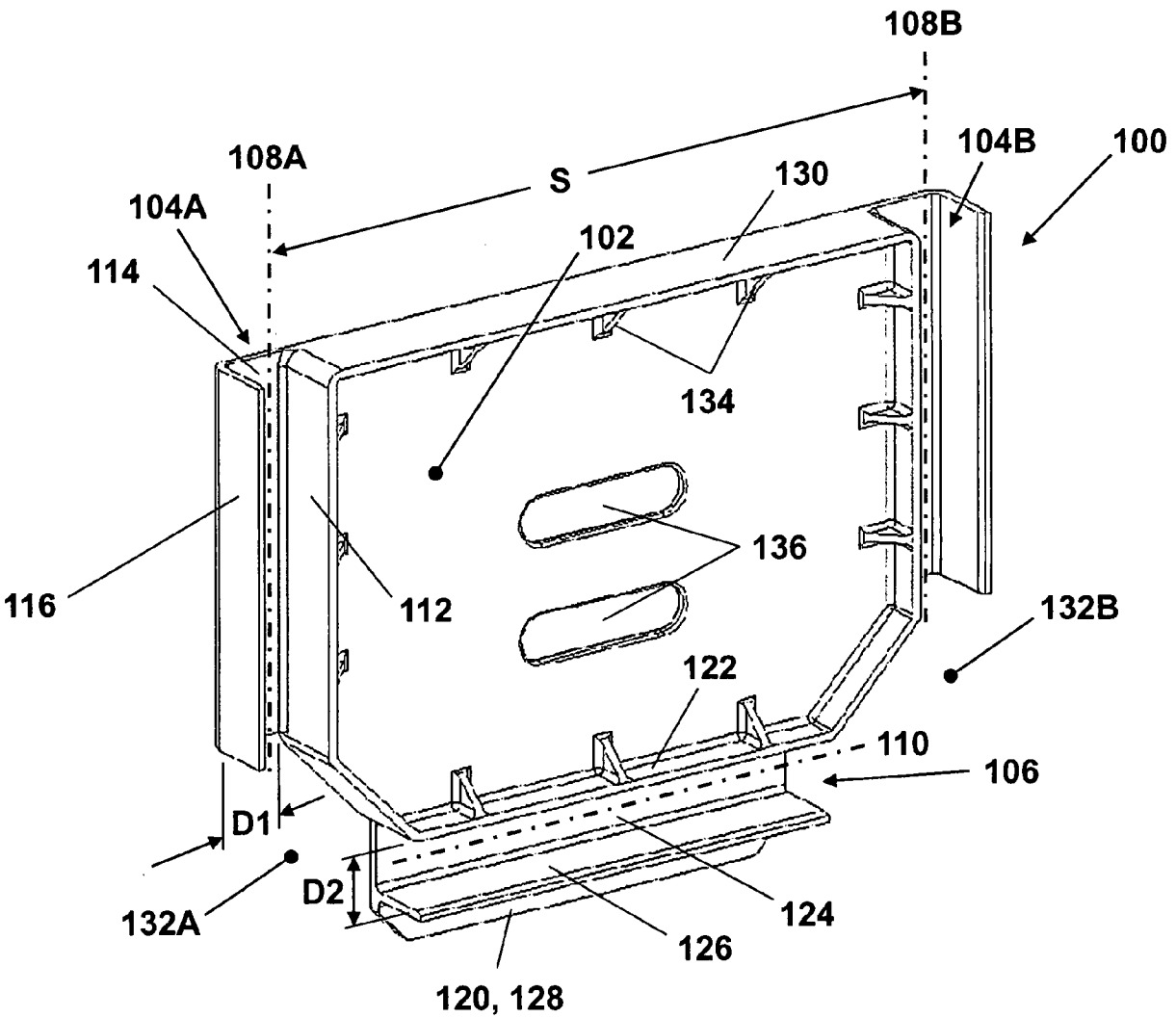
FIG. 1 is a front perspective view of a framing jig according to a first embodiment of the invention.
Figure 2:
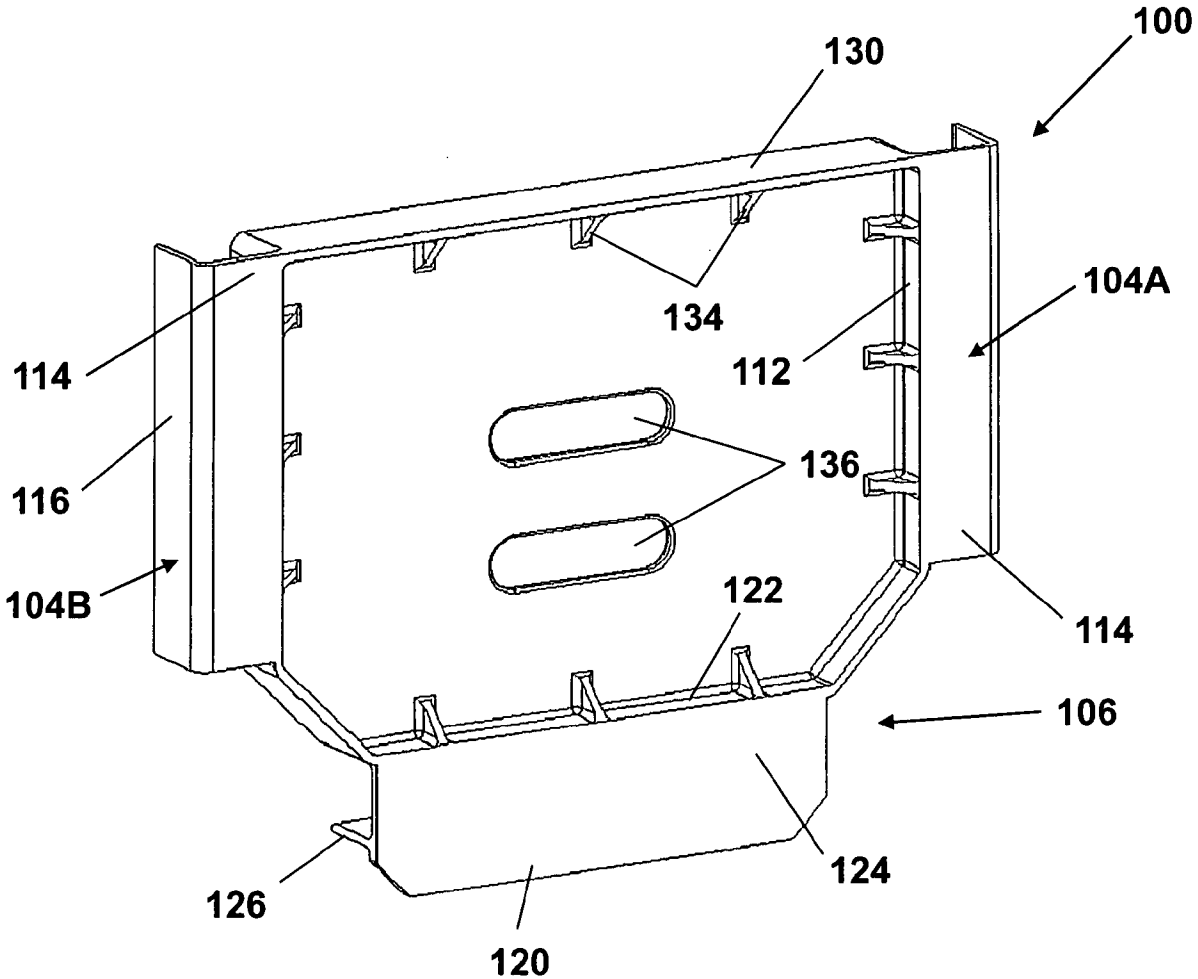
FIG. 2 is a rear perspective view of the jig shown in FIG. 1.

FIGS. 1 and 2 show front and rear perspective view of a jig 100 according to a first preferred embodiment. The jig 100 is a substantially rigid body formed from a resilient material such as plastic or aluminum. The jig 100 includes a central web such as that provided by planar substrate 102. A plurality of saddles 104, 106 are disposed about and connected to the planar substrate 102. The saddles 104, 106 are designed to abut standardized framing members (which are typically wood but may be metal) that are to be joined together by nailing or screwing. As illustrated, the saddles 104, 106 are preferably integrally formed with the planar substrate 102, for example in a plastic injection molding process or metal casting process, but it will be understood that in alternative embodiments the saddles can be mechanically fixed to the planar substrate 102, for example, by taking a separate U-shaped channel and attaching it to flange 130 using a pin and slot connection or other method of fixation.

In the particular embodiment shown in FIGS. 1 and 2, the jig 100 features two parallel stud saddles 104A, 104B and one header plate/sill saddle 106 (referred to herein as "sill saddle" for brevity) that is orientated transverse to the stud saddles 104. More particularly, stud saddles 104A, 104B have respective longitudinal axes 108A, 108B that are substantially parallel to one another, and sill saddle 106 has a longitudinal axis 110 that is substantially perpendicular to the longitudinal axes 108 of the stud saddles 104.

Figure 3:
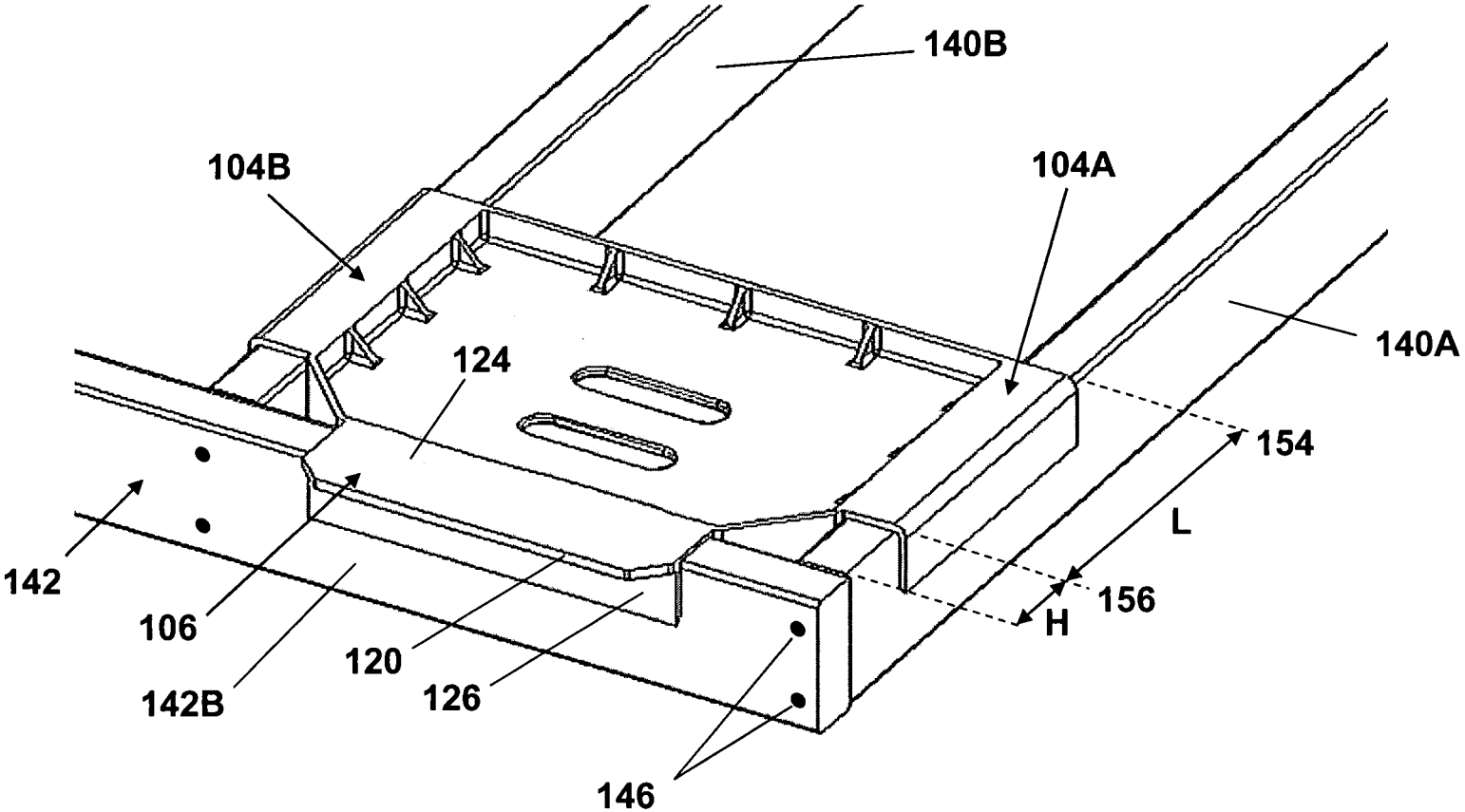
FIG. 3 is a perspective view of the jig shown in FIG. 1 in a horizontal framing application.
Figure 4:
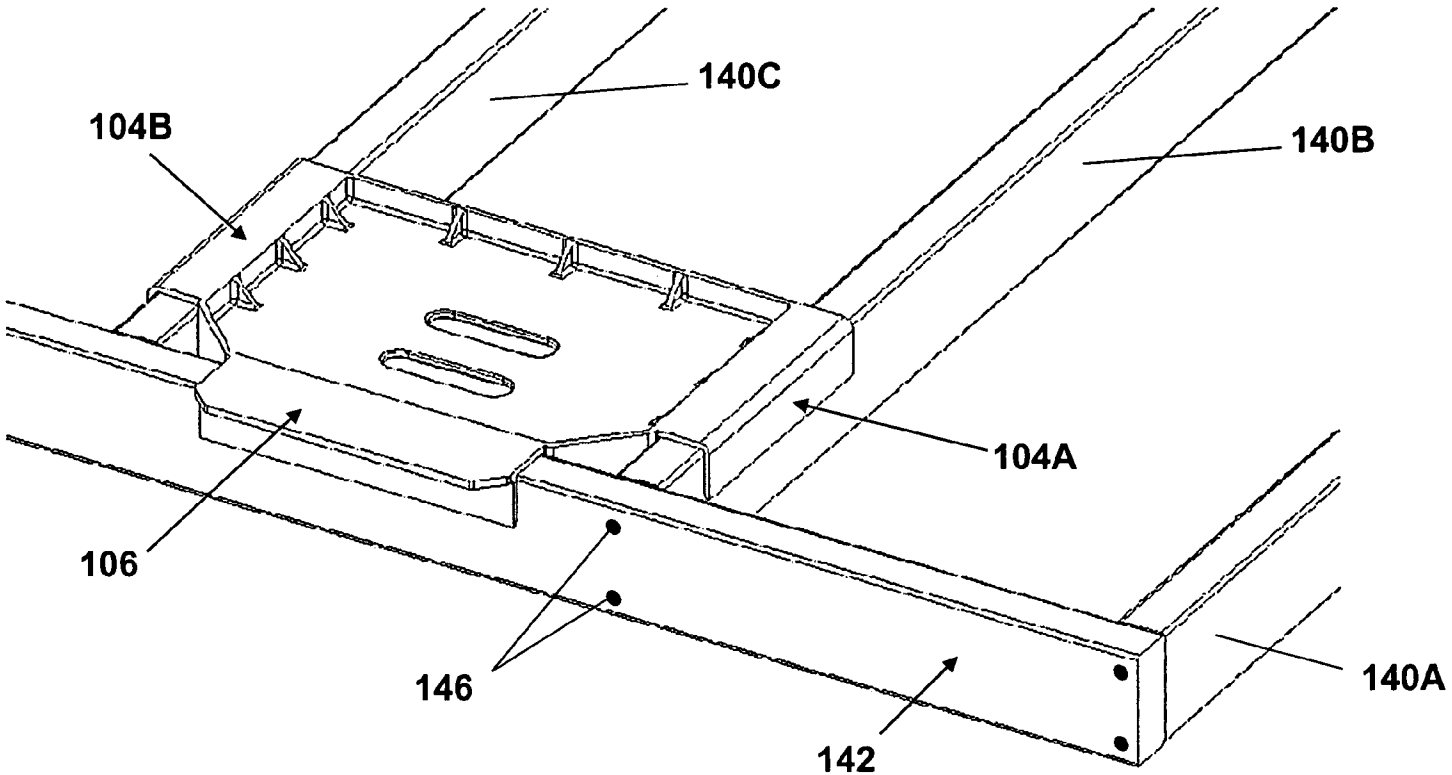
FIG. 4 is an perspective view of the jig shown in FIG. 1 in a continuation of the horizontal framing application shown in FIG. 3.

Each stud saddle 104A or 104B is preferably provisioned as a three-sided body to support three faces of a rectangular cross-sectioned framing member as will be seen for example in FIGS. 3 and 4. The three-sided body of stud saddle 104 is provided by a first sidewall 112 that is connected to and generally orthogonal to the planar substrate 102, a second sidewall 114 that is connected to the first sidewall and generally parallel with the planar substrate 102, and a third sidewall 116 connected to the second sidewall 114 and generally orthogonal to the planar substrate 102.

The sill saddle 106 is also preferably provisioned with a three-sided body. In addition, the preferred sill saddle 106 includes an additional outwardly extending flange 120 that is orientated in parallel to the planar substrate 102. This flange 120, when coupled with the three-sided body, provides in effect a complimentary two-sided saddle. More particularly, the three-sided body of the sill saddle 106 is provided by a first sidewall 122 that is connected to and generally orthogonal to the planar substrate 102, a second sidewall 124 that is connected to the first sidewall 122 and generally parallel with the planar substrate 102, and a third sidewall 126 connected to the second sidewall 124 and generally orthogonal to the planar substrate 102. The two-sided body of the sill saddle 106 is provided by the third sidewall 126 of the three-sided body and the flange 120, which is parallel to the second sidewall 124. The flange 120 is preferably formed through the preferred molding process as a seamless continuation of the second sidewall 124, but may be considered functionally as a fourth sidewall 128 connected to the second and third sidewalls 124, 126. The three-sided body of saddle 106 is useful in circumstances where the underside of the header plate or sill can be easily accessed and is of standard depth, and the two-sided body of saddle 106 is useful in circumstance where the underside of the header plate or sill cannot be easily accessed and/or is not of standard depth, as discussed in greater detail below.

The stud saddles 104 are preferably positioned at a predetermined spacing S apart to facilitate the positioning of framing studs at an industry standard spacing, such as 16 inches, center-to-center, or other standard spacing as the case may be depending on the application at hand.

The spacing D1 between the first and third sidewalls 112, 116 substantially defines the maximum width of a framing member that can be accommodated in the stud saddle 104. Likewise, the spacing D2 between the first and third sidewalls 122, 126 substantially defines the maximum width of a framing member that can be accommodated in the sill saddle 106. For use with conventional wood framing studs, D1 and D2 are preferably about 1.5 inches, which is the standard width for the nominal 2×4 or 2×6 wood framing studs widely commercially available.

The jig 100 is also characterized by open space between the stud saddles 104 and the sill saddle 106, as the sill saddle 106 is spaced apart from and not immediately adjacent to the first and second stud saddles 104A, 104B leaving a open corner 132A between the sill saddle 106 and stud saddle 104A and a open corner 132B between the sill saddle 106 and the second stud saddle 104B. The open corners 132A, 132B are preferably sized to allow adequate room for toe nailing and/or screwing studs and the like.

In the illustrated embodiment the jig 100 includes a circumferential flange 130 that fully surrounds the planar substrate 102. The flange 130, which is preferably integrally formed with the substrate 102, is oriented orthogonal to the substrate and provides or defines the first sidewalls 112, 122 of the stud and sill saddles 104, 106. The circumferential flange 130 increases the strength and stiffness of the jig 100, although it will be appreciated that the circumferential flange 130 is not essential and if provided need not fully surround the planar substrate 102. If desired, the jig 100 can also include stiffening ribs 134 distributed around the both sides of the intersection between the planar substrate 102 and the circumferential flange 130 to increase the strength and stiffness of the jig 100. Additionally or alternatively, the planar substrate 102 may have one or more hand hold apertures 136 therein to facilitate installation and removal of the jig from the framing members, and these apertures 126 may incorporate a flange or ring 138 around the edges thereof to reduce flex in the planar substrate.

FIG. 3 is a perspective view of the jig 100 in use in a horizontal framing application where the framing structure, comprising framing studs 140 joined to a sill 142, is built horizontally on the ground or other horizontal surface and then later lifted into place. In these circumstances the underside 142B of the sill 142 is accessible to the fabricator. The jig 100 is positioned so that the three-sided body of the sill saddle 106 straddles the sill 142 whilst the stud saddles 104 simultaneously engage end stud 140A and first interior stud 140B. The jig 100 holds the studs 140 and sill 142 in the correct location and at the correct orientation relative to one another thus enabling the fabricator to secure the end stud 140A and the first interior stud 140B to the sill 142 by driving fasteners 146 through the sill 142 into the ends of the studs 140.

Once the studs 140 are secured, the fabricator can then reposition the jig 100 so that one stud saddle engages the previously fastened first interior stud 140A and the sill 142 as shown in FIG. 4. Once the jig 100 has been re-positioned the fabricator can then position a second interior stud 140C with the jig 100 so that the second interior stud 140C abuts the sill 142. The fabricator can then fasten the second interior stud 140C to the sill 142 using the previously described fastening methods.

Figure 5:
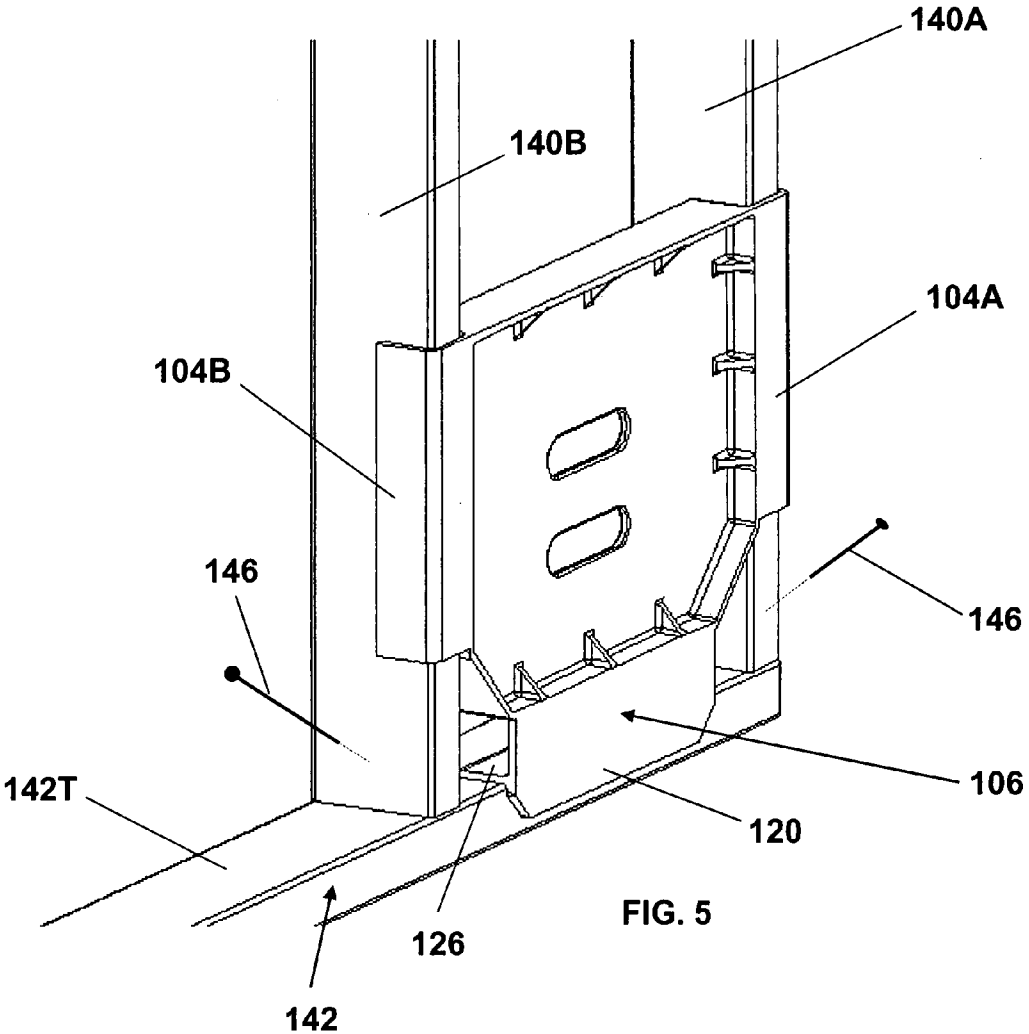
FIG. 5 is a perspective view of the jig shown in FIG. 1 in a vertical framing application.

FIG. 5 is perspective view of the jig 100 in use in a vertical framing application where the frame structure is typically built in situ so that the underside of the sill 142 (or topside of a header plate) is not accessible to the fabricator. The jig 100 is positioned so that the two-sided body of the sill saddle 106 straddles the accessible portion of the sill 106 whilst the stud saddles 104 simultaneously engage end stud 140A and first interior stud 140B. Thus, the outside orthogonal edge or third sidewall 126 of the sill saddle 106 rests on a horizontal surface 142T of the sill 142 and the flange 120 abuts the adjacent vertical surface of the sill 142. The jig 100 holds the studs 140 relative to the sill 142 at the correct location and at the correct orientation. The sill 140, although not entirely ensconced by the three-sided body of the sill saddle 106, is nonetheless prohibited from moving away from the studs 140 due to the ground (or ceiling) and is thus held in place, enabling the fabricator to secure the end stud 140A and the first interior stud 140B to the sill 142 by driving fasteners 146 in toenail fashion through the studs 140 into the sill 142.

Figure 6:
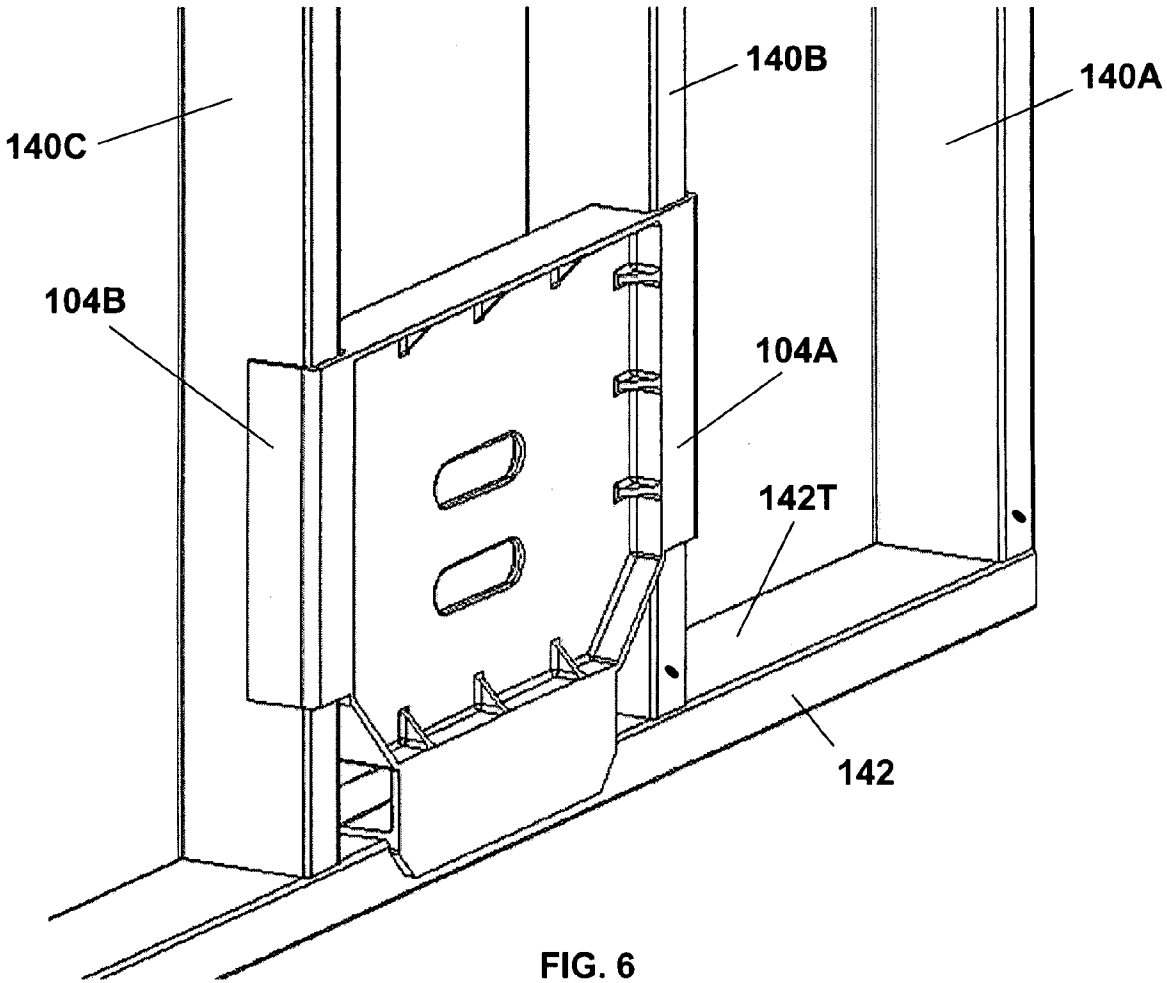
FIG. 6 is a perspective view of the jig shown in FIG. 1 in a continuation of the vertical framing application shown in FIG. 5.

Once the studs 140 are secured, the fabricator can then reposition the jig 100 so that one stud saddle 142A engages the previously fastened first interior stud 140A and the outside orthogonal edge or third sidewall 126 of the sill saddle 106 engages the horizontal surface 142T of the sill whilst the flange 120 abuts the adjacent vertical surface of the sill 142 as shown in FIG. 6. Once the jig 100 has been repositioned the fabricator can then engage the second interior stud 140C with the jig 100 so that the second interior stud 140C abuts the sill 142. The fabricator can then fasten the second interior stud 140C to the sill 142 using the previously described fastening methods.

Figure 7:
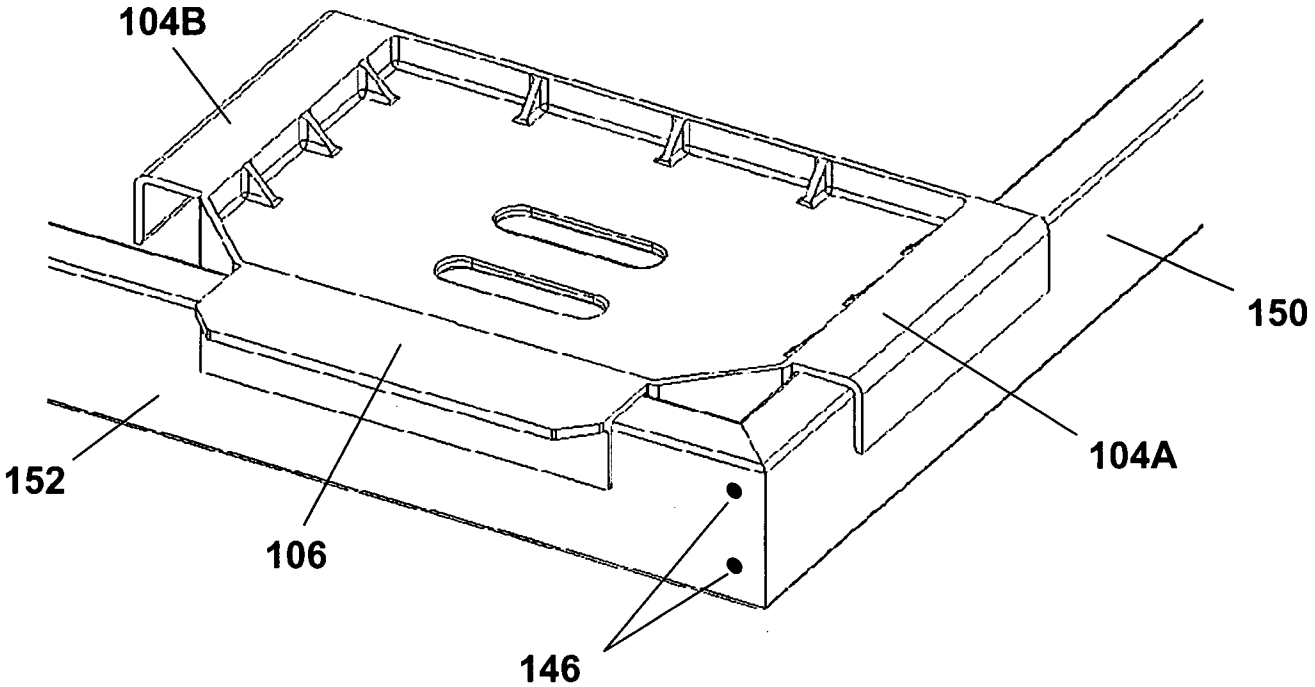
FIG. 7 is a perspective view of the jig shown in FIG. 1 in a mitered corner application.

FIG. 7 is perspective view of the jig 100 in use in a mitered corner application. The jig 100 is positioned so that one stud saddle 104A engages a first frame member 150 and the sill saddle 14 simultaneously engages a second frame member 152 thus enabling the fabricator to secure the frame members together with fasteners 146 while the frame members are in a perpendicular relationship with each other.

It should be noted that the open corners 132A, 132B of the jig 100 allow toe nailing from the front face or side face(s) of the studs. At the same time, it will be appreciated that the open corners force the stud saddles 104 to be raised in elevation in comparison to the elevational position of the sill saddle 106. As shown in FIG. 3, the stud saddle 104A has a longitudinal top end 154 and bottom end 156 defining a length L of the saddle. The bottom end 156 of the saddle is spaced apart a height H between the elevational position of the first sidewall 122 of the sill saddle 106. The height H is preferably selected in conjunction with a length L of the stud saddle 104 so that the stud saddle is capable of sufficiently holding and balancing a vertical stud whilst the fabricator is joining the framing members together. By way of example with respect to conventional 2×4 studs, the height H can be a minimum of two inches, and preferably closer to four inches, and if desired substantially higher. The length L can be a minimum of two to three inches, preferably about four to six inches, and it can readily be larger such as eight to twelve inches, although very large longitudinal dimensions are not advised since framing members are generally slightly warped. This is not a large problem over relatively small lengths since the sidewalls of the saddles are somewhat flexibly resilient to accommodate variations in the depth of the studs, but could be problematic for larger lengths L such as 24".

Figure 8:
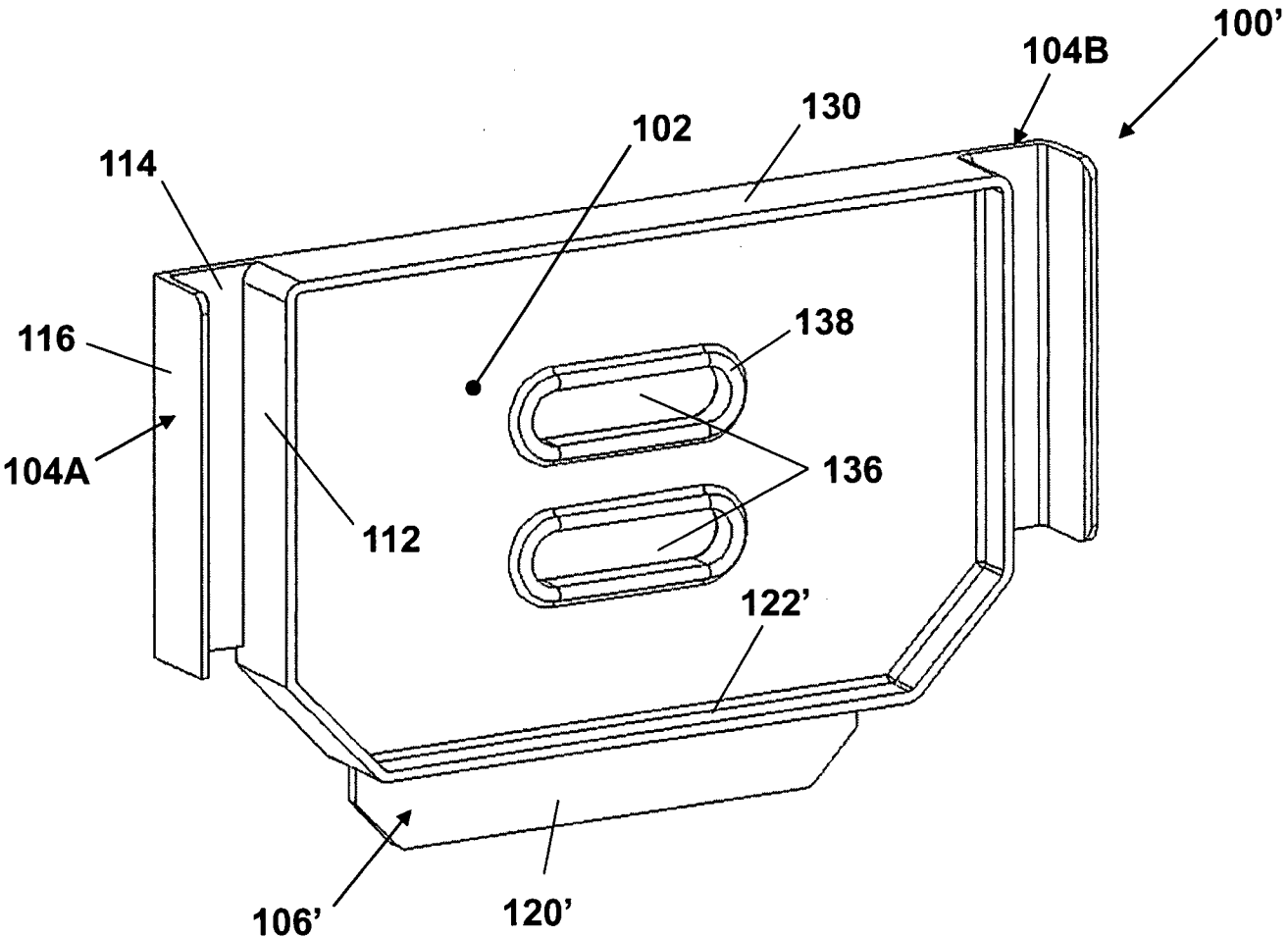
FIG. 8 is a front perspective view of a framing jig according to a second embodiment of the invention.
Figure 9:
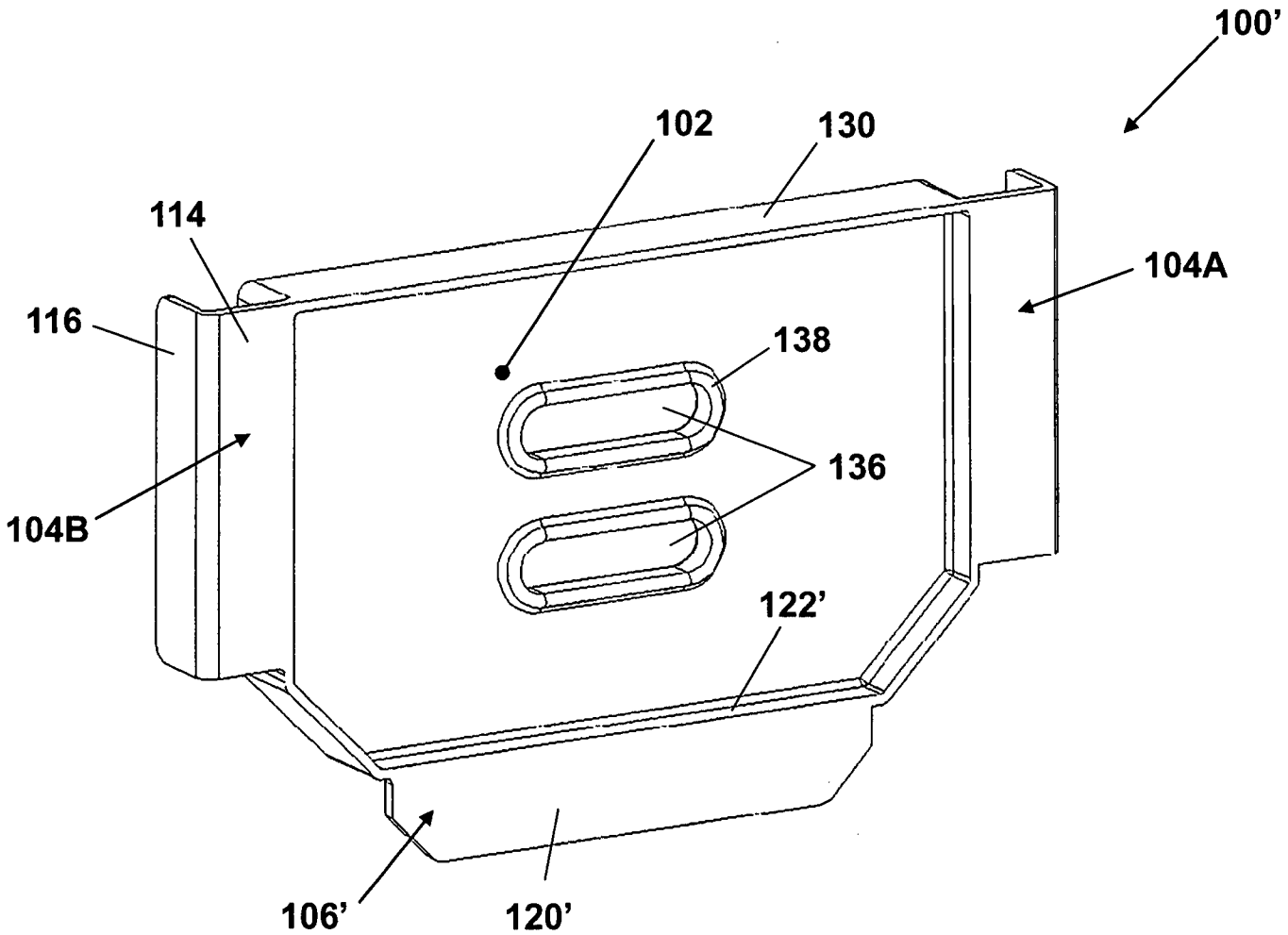
FIG. 9 is a rear perspective view of the jig shown in FIG. 8.
Figure 10:
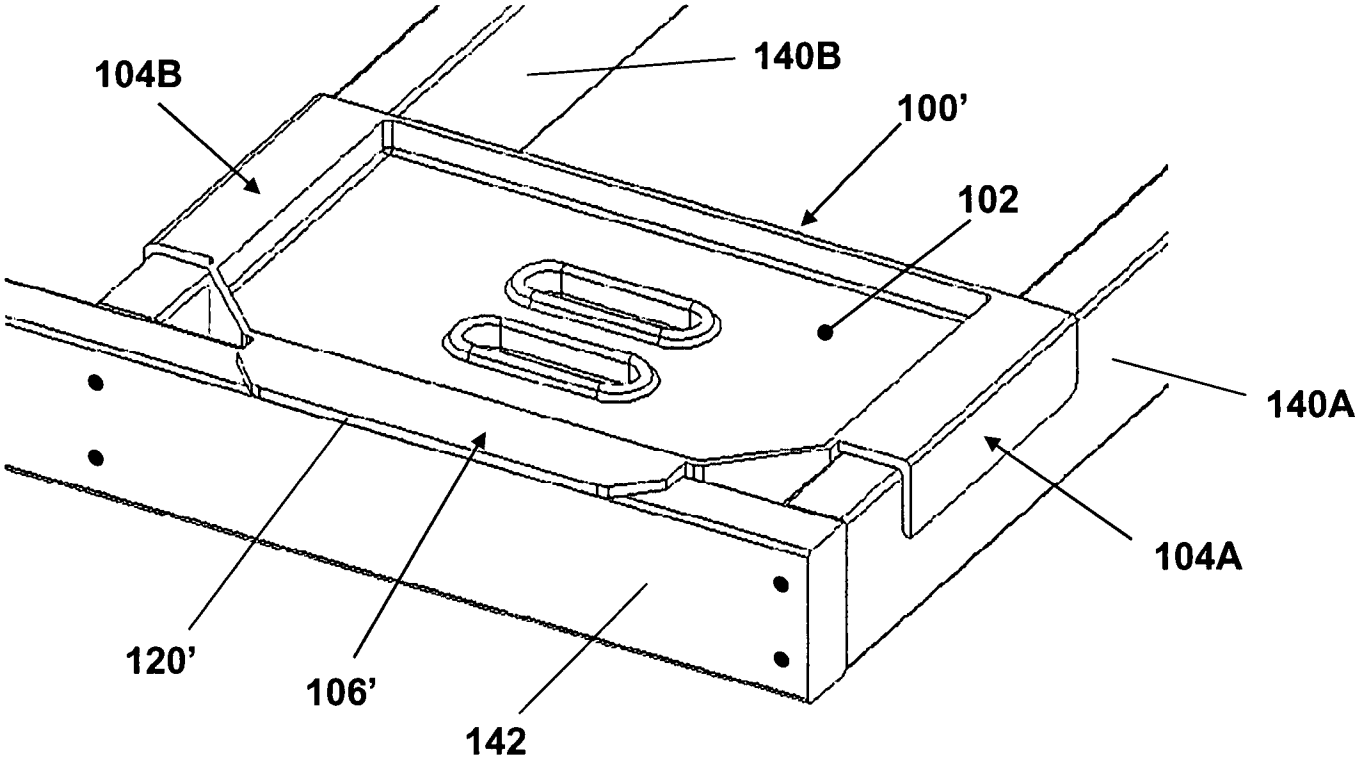
FIG. 10 is a perspective view of the jig shown in FIG. 8 in a horizontal framing application.
Figure 11:
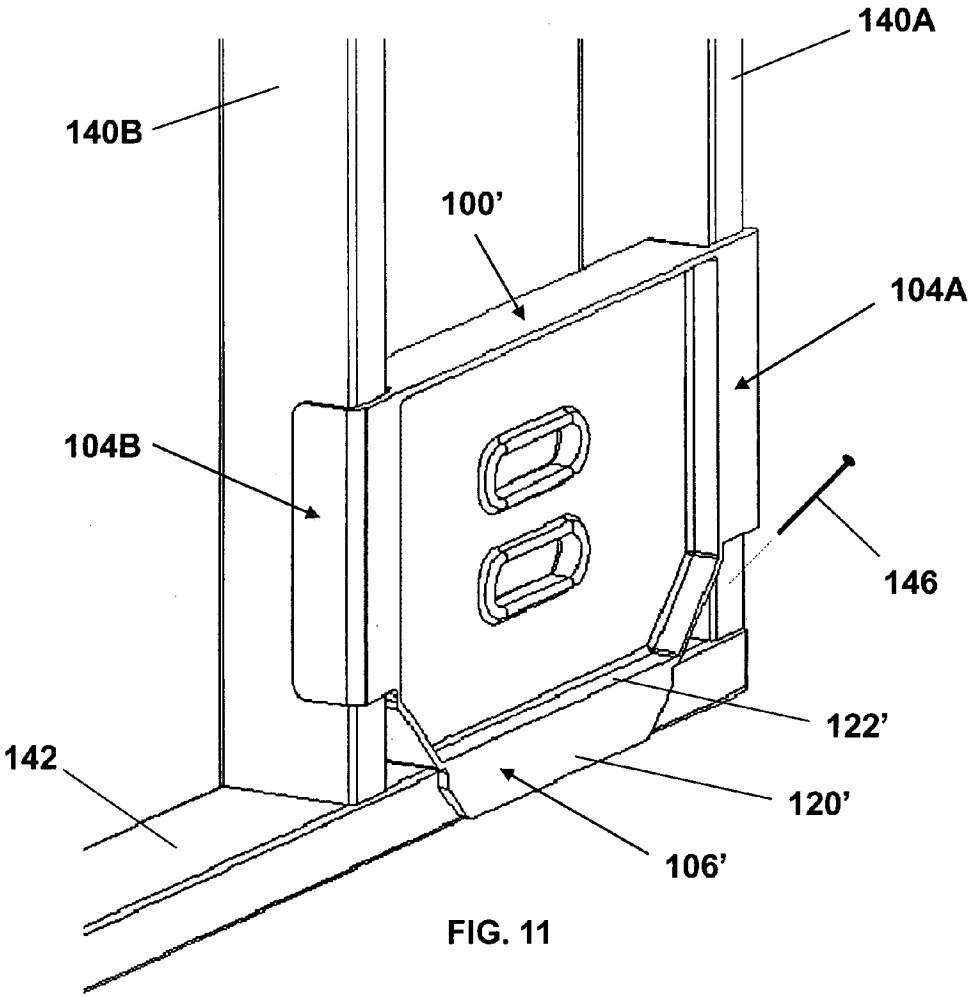
FIG. 11 is a perspective view of the jig shown in FIG. 8 in a vertical framing application.

FIGS. 8 and 9 are front and rear perspective views of an alternative framing jig 100', where similar parts are similarly numbered. In this embodiment, however, the sill saddle 106' is provided as a two sided body having a first sidewall 122' that is connected to and generally orthogonal to the planar substrate 102 and a second sidewall 120' that is connected to the first sidewall 122' and generally parallel with the planar substrate 102. As shown in the horizontal and vertical framing applications of FIGS. 9 and 10 respectively, this embodiment performs substantially similar to the jig 100 of the first embodiment, although in horizontal framing applications the sill saddle 106' does not entirely grasp the sill so the fabricator could need a hand or foot to help brace the sill plate during the fastening operation.

Likewise, it will be appreciated that in other alternative embodiments the third sidewall 116 on one or both the stud saddles 104A, 104B may be omitted, but this will have an effect on the effectiveness of the jig to hold the framing stud in place for nailing and the like.

Figure 12:
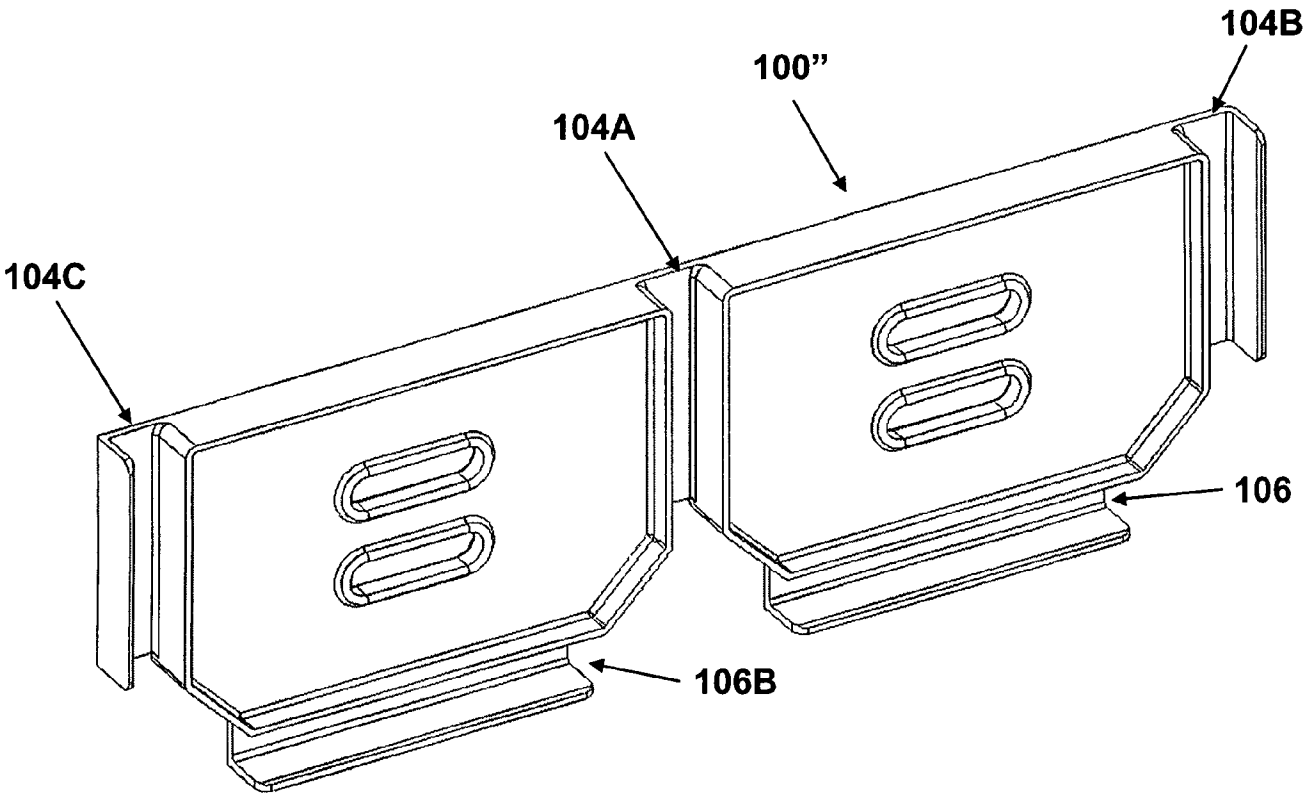
FIG. 12 is a front perspective view of a framing jig according to a third embodiment of the invention.

FIG. 12 is front perspective view of a third embodiment of a jig 100", where the central web is extended and the jig includes a third stud saddle 104C and a second sill saddle 106B.

The above-described embodiments of the invention are intended to be examples of the invention and alterations and modifications may be effected thereto, by those of skill in the art, without departing from the spirit of the invention.

I claim:

1. A framing aid, comprising:

a rigid, non-foldable central web;

at least first and second stud saddles connected to the web, the first stud saddle having a first longitudinal axis and the second stud saddle having a second longitudinal axis, the first and second longitudinal axes being substantially parallel to one another;

at least one sill saddle connected to the web, the sill saddle having a third longitudinal axis that is substantially perpendicular to the first and second longitudinal axes of the stud saddles, wherein the sill saddle is spaced apart and not immediately adjacent to the first and second stud saddles so as to provide a first opening between the sill saddle and the first stud saddle and a second opening between the sill saddle and the second stud saddle, the openings each being adequately sized for toe nailing studs;

wherein each of the first and second stud saddles is a three-sided body having first, second and third sidewalls, the first sidewall being connected to and generally orthogonal to the substrate, the second sidewall being connected to the first sidewall and generally parallel with the substrate, and third sidewall being connected to the second sidewall and generally orthogonal to the substrate, wherein the spacing between the first and third sidewalls substantially defines the maximum depth of a framing stud accommodated in the saddle.

2. A framing aid according to claim 1, wherein the connection of the saddles to the central web is achieved by integrally forming the web with the saddles or by mechanically connecting the web with the saddles.

3. A framing aid according to claim 2, wherein the central web comprises a planar substrate having a first side and a second side substantially perpendicular to the first side, the first stud saddle being disposed adjacent to the first side of the substrate and the sill saddle being disposed adjacent the second side of the substrate.

4. A framing aid according to claim 3, wherein the sill saddle includes a two-sided body having first and second sidewalls, the first sidewall being connected and generally orthogonal to the substrate and the second sidewall being connected to and generally parallel with the substrate.

5. A framing aid according to claim 3, wherein the sill saddle includes a three-sided body having first, second and third sidewalls, the first sidewall being connected and generally orthogonal to the substrate, the second sidewall being connected to the first sidewall and generally parallel with the substrate, and the third sidewall being connected to the second sidewall, wherein the spacing between the first and third saddle sides substantially defines the maximum depth of a stud accommodated in the saddle.

6. A framing aid according to claim 5 wherein the sill saddle further comprises a two-sided sill body connected to the three-sided body, the two-sided body comprising the third wall of the three-sided body and a fourth wall connected to and parallel with the second wall of the three-sided body.

7. A framing aid according to claim 3, wherein the planar substrate includes at least one aperture formed therein having a flange at the periphery of the aperture for stiffening the substrate.

8. A framing aid according to claim 3, including a flange substantially circumscribing the planar substrate, the flange being orientated substantially orthogonal to the substrate.

9. A framing aid according to claim 8, wherein the flange defines a portion of each of the saddles.

10. A framing aid according to claim 1, including a third stud saddle connected to the web, the third stud saddle having a third longitudinal axis that is substantially parallel to the second longitudinal axis.

11. A framing aid, comprising:

a central planar web;

at least three stud-gripping saddles connected to the central planar web, wherein each saddle has a longitudinal axis and at least two of the saddles have longitudinal axes parallel to each other and the longitudinal axis of at least one saddle is perpendicular to the at least two parallel saddles; and wherein the perpendicular saddle has two substantially parallel walls orientated substantially perpendicular to the central planar web interconnected by a third wall substantially perpendicular to the two parallel walls, the third wall having a flange that extends outwardly parallel to and away from the central planar web past the parallel walls.

12. A framing aid, comprising:

a central web including a planar substrate;

first and second stud saddles connected to the web, the first stud saddle having a first longitudinal axis and the second stud saddle having a second longitudinal axis, the first and second longitudinal axes being substantially parallel to one another, wherein each of the first and second stud saddles is a three-sided body having a first sidewall connected to and generally orthogonal to the substrate, a second sidewall connected to the first sidewall and generally parallel with the substrate, and a third sidewall connected to the second sidewall and generally orthogonal to the substrate;

a sill saddle connected to the web, the sill saddle having a third longitudinal axis that is substantially perpendicular to the first and second longitudinal axes of the stud saddles, the sill saddle comprising a three-sided body connected to a two-sided body, the three sided body having a first sidewall connected and generally orthogonal to the substrate, a second sidewall connected to the first sidewall and generally parallel with the substrate, and a third sidewall connected to the second sidewall, the two-sided body comprising the third wall of the three-sided body and a fourth wall connected to and parallel with the second wall of the three-sided body.

13. A framing aid, according to claim 12, wherein the sill saddle is spaced apart and not immediately adjacent to the first and second stud saddles so as to provide a first opening between the sill saddle and the first stud saddle and a second opening between the sill saddle and the second stud saddle, the openings each being adequately sized for toe nailing studs.

14. A framing aid according to claim 12, wherein the planar substrate includes at least one aperture formed therein having a flange at the periphery of the aperture for stiffening the substrate.

15. A framing aid according to claim 12, including a flange substantially circumscribing the planar substrate, the flange being orientated substantially orthogonal to the substrate.

16. A framing aid according to claim 15, wherein the flange defines a portion of each of the saddles.

17. A framing aid according to claim 12, including a third stud saddle connected to the web, the third stud saddle having a third longitudinal axis that is substantially parallel to the second longitudinal axis.

* * * * *